US010867573B2

(12) United States Patent
Liu et al.

(10) Patent No.: US 10,867,573 B2
(45) Date of Patent: Dec. 15, 2020

(54) COMMON VOLTAGE CONTROL CIRCUIT AND METHOD, DISPLAY PANEL AND DISPLAY DEVICE

(71) Applicants: BOE TECHNOLOGY GROUP CO., LTD., Beijing (CN); BEIJING BOE SPECIAL DISPLAY TECHNOLOGY CO., LTD., Beijing (CN)

(72) Inventors: Xiaolong Liu, Beijing (CN); Shihao Wang, Beijing (CN); Zhicheng Wang, Beijing (CN); Shenglin Sun, Beijing (CN); Junguo Liu, Beijing (CN)

(73) Assignees: BOE TECHNOLOGY GROUP CO., LTD., Beijing (CN); BEIJING BOE SPECIAL DISPLAY TECHNOLOGY CO., LTD., Beijing (CN)

( * ) Notice: Subject to any disclaimer, the term of this patent is extended or adjusted under 35 U.S.C. 154(b) by 41 days.

(21) Appl. No.: 15/757,884

(22) PCT Filed: Sep. 4, 2017

(86) PCT No.: PCT/CN2017/100379
§ 371 (c)(1),
(2) Date: Mar. 6, 2018

(87) PCT Pub. No.: WO2018/153050
PCT Pub. Date: Aug. 30, 2018

(65) Prior Publication Data

US 2019/0355322 A1 Nov. 21, 2019
US 2020/0342828 A9 Oct. 29, 2020

(30) Foreign Application Priority Data

Feb. 23, 2017 (CN) ..... 2017 1 0098945

(51) Int. Cl.
*G09G 3/36* (2006.01)

(52) U.S. Cl.
CPC ... *G09G 3/3696* (2013.01); *G09G 2310/0264* (2013.01); *G09G 2320/041* (2013.01)

(58) Field of Classification Search
CPC ..... G09G 3/3696; G09G 2310/0264; G09G 2320/041
USPC ..... 345/212
See application file for complete search history.

(56) References Cited

U.S. PATENT DOCUMENTS

2009/0278832 A1* 11/2009 Cho ..... G09G 3/3648 345/211
2010/0045859 A1* 2/2010 Starr ..... G09G 3/20 348/447

(Continued)

FOREIGN PATENT DOCUMENTS

CN 102201217 A 9/2011
CN 202217488 U 5/2012

(Continued)

OTHER PUBLICATIONS

English translation of PCT International Search Report, Application No. PCT/CN2017/100379, dated Nov. 29, 2017, 5 pages.

(Continued)

*Primary Examiner* — Amare Mengistu
*Assistant Examiner* — Gloryvid Figueroa-Gibson
(74) *Attorney, Agent, or Firm* — Armstrong Teasdale LLP

(57) ABSTRACT

Provided in the embodiments of the disclosure are a common voltage control circuit and method, a display panel and a display device. The control circuit includes a temperature sensing circuit and a voltage adjusting circuit. The temperature sensing circuit is configured to sense the ambient temperature. The voltage adjusting circuit is coupled to the temperature sensing circuit and the common electrode, and is configured to provide a corresponding common voltage to the common electrode based on a temperature signal from (Continued)

the temperature sensing circuit. According to the embodiments of the present disclosure, the common voltage may be changed according to the ambient temperature to improve the image sticking.

10 Claims, 3 Drawing Sheets

(56) References Cited

U.S. PATENT DOCUMENTS

| | | | | |
|---|---|---|---|---|
| 2014/0111499 | A1 | 4/2014 | Jang et al. | |
| 2016/0149574 | A1* | 5/2016 | Cui | H03K 19/00369 327/513 |

FOREIGN PATENT DOCUMENTS

| | | | |
|---|---|---|---|
| CN | 103295541 | A | 9/2013 |
| CN | 103794183 | A | 5/2014 |
| CN | 104232105 | A | 12/2014 |
| CN | 104460076 | A | 3/2015 |
| CN | 104610977 | A | 5/2015 |
| CN | 104778934 | A | 7/2015 |
| CN | 105096880 | A | 11/2015 |
| CN | 105096894 | A | 11/2015 |
| CN | 106328093 | A | 1/2017 |
| CN | 106847212 | A | 6/2017 |
| KR | 20070014535 | A | 2/2007 |

OTHER PUBLICATIONS

PCT Written Opinion, Application No. PCT/CN2017/100379, dated Nov. 29, 2017, 6 pages.: with English translation of relevant part.

China First Office Action, Application No. 201710098945.5, dated Sep. 25, 2018, 22 pps.: with English translation.

Chinese Reexamination Notification for application No. 201710098945.5 dated Jun. 19, 2020, 6 pps. With English translation.

* cited by examiner

COMMON VOLTAGE CONTROL CIRCUIT AND METHOD, DISPLAY PANEL AND DISPLAY DEVICE

CROSS REFERENCE TO RELATED APPLICATIONS

This patent application is a National Stage Entry of PCT/CN2017/100379 filed on Sep. 4, 2017, which claims the benefit and priority of Chinese Patent Application No. 201710098945.5 filed on Feb. 23, 2017, the disclosures of which are incorporated herein by reference in their entirety as part of this the present application.

BACKGROUND

Embodiments of the present disclosure relate to the field of display technology, and in particular, to a common voltage control circuit and method, a display panel and a display device.

Liquid crystal display devices have been widely used. In a liquid crystal display device, a pixel electrode and a common electrode are used to drive a liquid crystal layer, such that liquid crystal molecules rotate to control light passing through the liquid crystal layer, thereby displaying different contents. In this process, the driving voltage difference between a driving voltage applied to the pixel electrode and a common voltage applied to the common electrode is changed, so as to change the degree of rotation of the liquid crystal molecules.

When a liquid crystal display device is used to continuously display the same static image, image sticking may occur. In this case, even if the content of the displayed image is changed, the trace of the previous static image can still be seen on the screen of the liquid crystal display device. It is generally believed that this is caused by the polarization of the liquid crystal material itself and the accumulation of ionic impurities in the liquid crystal material, such that a direct current (DC) bias voltage exists across two sides of the liquid crystal layer, and the degree of rotation of the liquid crystal molecules will no longer be able to exactly change as the driving voltages change.

In order to avoid the occurrence of image sticking, the composition of the liquid crystal material can be improved, and the purity of the liquid crystal material can be increased to reduce ionic impurities. However, liquid crystal materials have a long development cycle and high cost, and the performance of new materials cannot be completely guaranteed. In addition, under the current process conditions, it is difficult to further improve the purity of the liquid crystal material during the production process, and ionic impurities might also be gradually mixed into the liquid crystal material during use.

Therefore, there is room for improvement in existing display devices.

BRIEF DESCRIPTION

Embodiments of the present disclosure provide a common voltage control circuit and method, a display panel and a display device.

A first aspect of the present disclosure provides a control circuit for controlling a common voltage applied to a common electrode of a display panel. The control circuit includes a temperature sensing circuit and a voltage adjusting circuit. The temperature sensing circuit is configured to sense the ambient temperature of the display panel. The voltage adjusting circuit is coupled to the temperature sensing circuit and the common electrode, and is configured to provide a corresponding common voltage to the common electrode based on a temperature signal from the temperature sensing circuit.

In an embodiment of the present disclosure, the corresponding common voltage enables the display panel to have the smallest flicker at the sensed ambient temperature.

In an embodiment of the present disclosure, the temperature sensing circuit includes a temperature sensor. The voltage adjusting circuit includes a microcontroller and a digital potentiometer. The microcontroller determines a common voltage value corresponding to the sensed ambient temperature, based on the temperature signal from the temperature sensor and the pre-established correlation between the ambient temperature of the display panel and the corresponding common voltage for the smallest flicker. The digital potentiometer is configured to generate the corresponding common voltage based on the determined common voltage value.

In an embodiment of the present disclosure, the temperature sensing circuit includes a thermistor. The voltage adjusting circuit includes a resistance voltage divider. The thermistor is coupled in series between the resistance voltage divider and a ground. The resistance voltage divider is further coupled to a reference power source. The coupling point, at which the resistance voltage divider and the thermistor are coupled in series, is coupled to the common electrode.

In an embodiment of the present disclosure, the resistance voltage divider is a fixed resistor.

A second aspect of the present disclosure provides a control method for controlling a common voltage applied to a common electrode of a display panel. The control method includes sensing an ambient temperature, and providing a corresponding common voltage to the common electrode based on the ambient temperature.

In an embodiment of the present disclosure, the corresponding common voltage enables the display panel to have the smallest flicker at the sensed ambient temperature.

In an embodiment of the present disclosure, providing a corresponding common voltage to the common electrode based on the ambient temperature includes determining a common voltage value corresponding to the ambient temperature, based on the ambient temperature and the pre-established correlation between the ambient temperature of the display panel and the corresponding common voltage for the smallest flicker, and providing the common electrode with the corresponding common voltage based on the corresponding common voltage value.

In an embodiment of the present disclosure, the common voltage increases as the ambient temperature increases, within a specified range from a normal temperature to a high temperature.

In an embodiment of the present disclosure, the specified range from the normal temperature to the high temperature is a range of being greater than or equal to 25° C. and less than or equal to 50° C.

In an embodiment of the present disclosure, a range of adjustment of the common voltage is a range of being greater than or equal to a first threshold and less than or equal to a second threshold.

In an embodiment of the present disclosure, the first threshold is equal to a common voltage corresponding to the smallest flicker at the normal temperature, subtracted by 1V, and the second threshold is equal to a common voltage corresponding to the smallest flicker at the normal temperature added with 1V.

A third aspect of the present disclosure provides a display panel including the control circuit of any one of the foregoing.

A fourth aspect of the present disclosure provides a display device including the foregoing display panel.

According to the common voltage control circuit and method, the display panel and the display device according to the embodiments of the present disclosure, the common voltage can be changed according to the ambient temperature so as to improve the image sticking.

BRIEF DESCRIPTION OF THE DRAWINGS

In order to more clearly illustrate the technical solutions of the embodiments of the disclosure, the drawings of the embodiments will be briefly described below, and it should be appreciated that the drawings described below merely relate to some of the embodiments of the disclosure, rather than limiting the disclosure, in which.

DETAILED DESCRIPTION

In order to make the technical solutions and advantages of the embodiments of the disclosure clearer, the technical solutions in the embodiments of the disclosure will be clearly and completely described below in conjunction with accompanying drawings. It is obvious that the described embodiments are part, instead of all, of the embodiments of the disclosure. All other embodiments obtained by those skilled in the art based on the described embodiments of the disclosure without the need for creative labor also fall within the scope of the disclosure.

Figure 1:
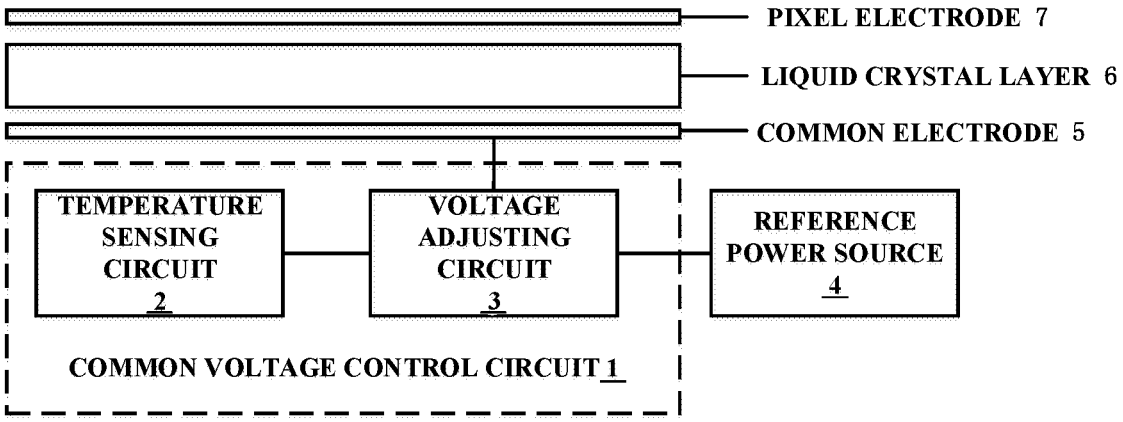
FIG. 1 is a block diagram of a common voltage control circuit of an embodiment of the present disclosure.

FIG. 1 is a block diagram of a common voltage control circuit of an embodiment of the present disclosure. As shown in FIG. 1, the display panel includes a common electrode 5, a pixel electrode 7, and a liquid crystal layer 6 between the common electrode 5 and the pixel electrode 7. A common voltage control circuit 1 is a control circuit for controlling a common voltage applied to the common electrode 5 of the display panel. The common voltage control circuit 1 is coupled to the common electrode 5 to provide the common voltage to the common electrode 5. The common voltage control circuit 1 includes a temperature sensing circuit 2 and a voltage adjusting circuit 3. The temperature sensing circuit 2 is configured to sense the ambient temperature and transmit a temperature signal to the voltage adjusting circuit 3. The voltage adjusting circuit 3 is coupled to the common electrode 5 and is configured to provide a corresponding common voltage to the common electrode 5 based on the temperature signal from the temperature sensing circuit 2.

Further, the voltage adjusting circuit 3 may be coupled to a reference power source 4. The voltage adjusting circuit 3 may perform a voltage division on the reference power source 4 to obtain a desired common voltage.

At different temperatures, corresponding to the same voltage difference between the pixel electrode and the common electrode, the degree of rotation of liquid crystal molecules may also be different, which increases the possibility of occurrence of image sticking. The common voltage control circuit 1 according to the embodiment of the present disclosure can change the voltage of the common electrode according to the temperature signal so as to change the voltage difference, such that the degree of rotation of the liquid crystal molecules can be adjusted in a simple manner, to avoid the occurrence of image sticking.

The corresponding common voltage may be a common voltage that enables the display panel to have the smallest flicker at the sensed ambient temperature. Here, the degree of flickering can be measured using any existing flicker measurement method. Such a method may be, for example, a flicker measurement method disclosed in an information display measurement standard (IDMS) issued by Society for Information Display (SID).

The common voltage control circuit 1 according to the embodiment of the present disclosure further uses the common voltage corresponding to the smallest flicker, and reduces the asymmetry of liquid crystal molecule control when the polarity of the voltage on the pixel electrode is periodically changed, so as to avoid the occurrence of image sticking better.

Figure 2:
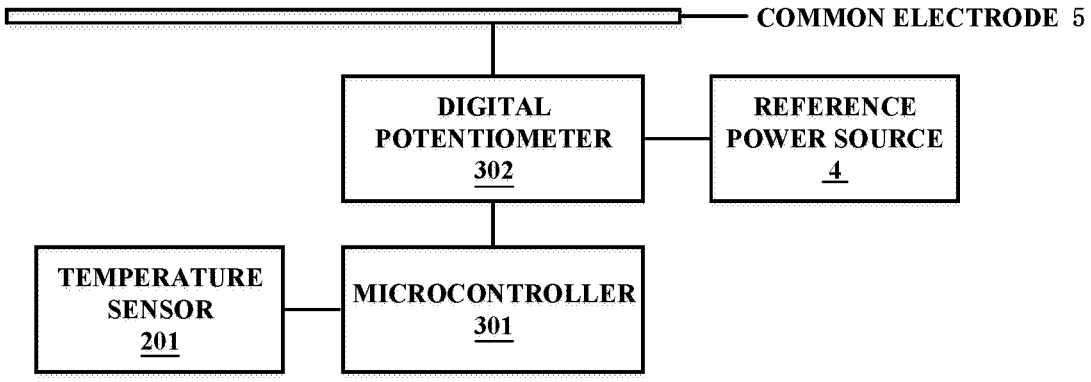
FIG. 2 is a schematic block diagram of the common voltage control circuit shown in FIG. 1.

FIG. 2 is a schematic block diagram of the common voltage control circuit shown in FIG. 1. As shown in FIG. 2, the temperature sensing circuit 2 may include a temperature sensor 201. The voltage adjusting circuit 3 may include a microcontroller 301 (for example, an MCU) and a digital potentiometer 302. The temperature sensor 201 senses the ambient temperature and generates a temperature signal. The temperature signal can be a voltage signal with a voltage magnitude corresponding to the temperature value. The temperature signal can also be a digital signal, the value of which corresponds to the temperature value. The microcontroller 301 determines the common voltage value corresponding to the sensed ambient temperature, according to the temperature signal from the temperature sensor 201 and the pre-established correlation between the ambient temperature and the common voltage corresponding to the smallest flicker. The microcontroller 301 adjusts the resistance of the digital potentiometer 302 according to the required common voltage value. The digital potentiometer 302 can be used for performing a voltage division on the reference power source 4 to obtain a desired common voltage. The common voltage is applied to the common electrode 5.

The microcontroller 301 can also be a variety of other types of control devices such as DSPs, FPGAs, and the like.

In an embodiment of the present disclosure, the output of the temperature sensor 201 can be used to enable the microcontroller 301 to regulate the common voltage more properly and improve the image sticking.

Figure 3:
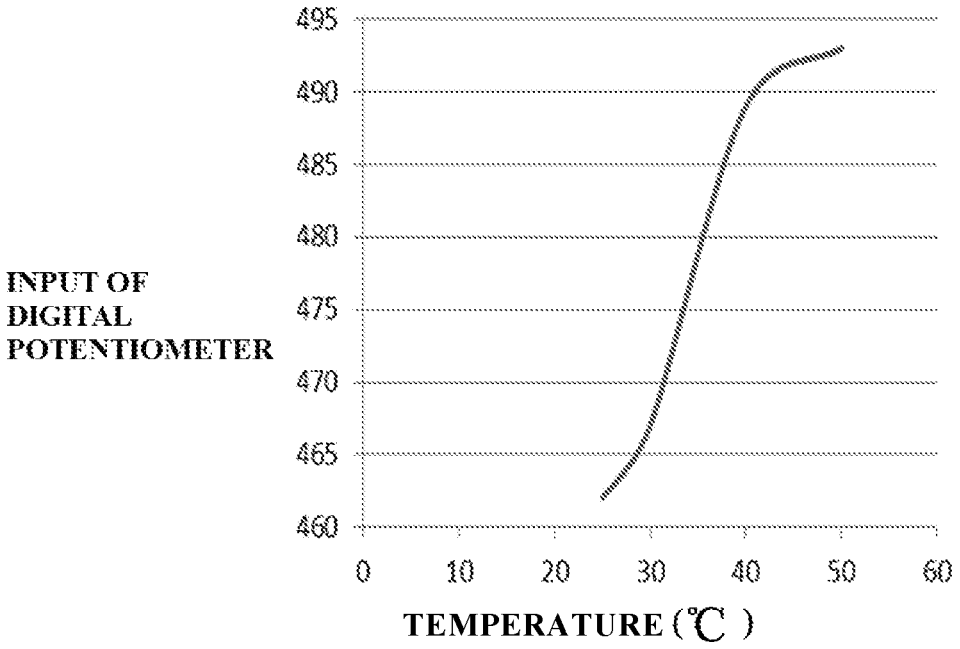
FIG. 3 is a schematic diagram of the relationship between temperature and common voltage used in an embodiment of the present disclosure.

FIG. 3 is a schematic diagram of the relationship between temperature and common voltage used in an embodiment of the present disclosure. As shown in FIG. 3, for one exemplary liquid crystal display device, a measurement of the common voltage corresponding to the smallest flicker is performed within a selected temperature range. The temperature range can be a range from a normal temperature to a high temperature. Here, the normal temperature and the high temperature can be determined according to the test requirements of the liquid crystal display device. For example, according to commonly used settings, the normal temperature may be 25° C., and the high temperature may be 50° C. In this temperature range, the measurement can be performed at regular temperature intervals. For example, the measurement can be performed at an interval of 5° C., e.g., at 25° C., 30° C., 35° C., and so forth. Of course, the measurement may also be performed at irregular temperature intervals, and more or less points may also be selected. These pre-measured data can be represented by the curve shown in FIG. 3. In general, with more test points, the curve is more accurate.

In a liquid crystal display device, a digital potentiometer is often used to perform a voltage division on a reference power source to obtain a common voltage. For the ordinate in FIG. 3, the value of the input of the digital potentiometer is directly used, input values correspond to common voltage one to one and there is a proportional relationship therebetween. For example, 460 in FIG. 3 corresponds to a voltage of 4.5V, and 470 corresponds to a voltage of 4.6V. Directly used is the relationship curve between input values and temperatures, which is easy to store and use. As an example of a test point, the curve in FIG. 3 contains the following data points (25° C., 462), (30° C., 467), (40° C., 489), (50° C., 493).

In the embodiment of the present disclosure, the substantially proportional relationship shown in FIG. 3 or similar can well improve the image sticking problem of the liquid crystal display device. In particular, the common liquid crystal display device is prone to the problem that image sticking does not occur at normal temperature, but occurs at high temperature. That is, it is possible to set the common voltage to increase as the ambient temperature increases within a specified range from the normal temperature to the high temperature (for example, a range of being greater than or equal to 25° C. and less than or equal to 50° C. shown in FIG. 3). It should be understood that the temperature range or the proportional relationship is not a limitation of the present disclosure, and the temperature range or the correlation may be adaptively modified in a specific application.

In addition, in order to prevent the circuit structure of the display device from being affected, the range of adjustment of the common voltage may be set according to the endurance capacity of the circuit of the display device. The range of adjustment of the common voltage may be set to be greater than or equal to the first threshold and less than or equal to the second threshold which is greater than the first threshold. For example, it may be set according to a common voltage corresponding to the smallest flicker at normal temperature. The first threshold may be a common voltage at normal temperature subtracted by 1V, and the second threshold may be a common voltage at normal temperature added with 1V. In FIG. 3, the common voltage at normal temperature (25° C.) is set to 4.52V (corresponding to 462), the first threshold may be 3.52V and the second threshold may be 5.52V.

Figure 4:
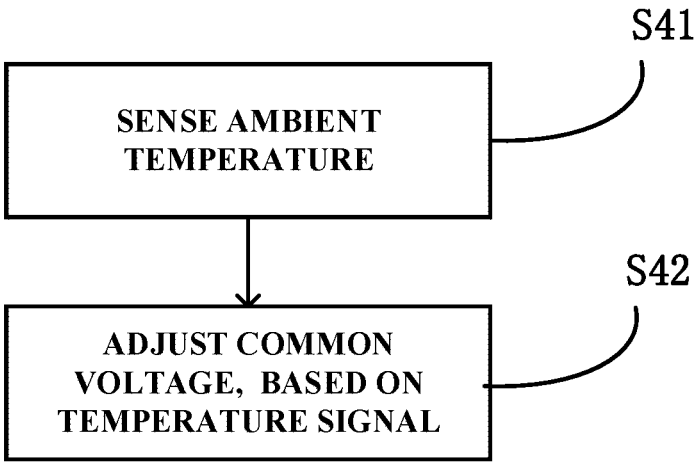
FIG. 4 is a flowchart of a common voltage control method of an embodiment of the present disclosure.

FIG. 4 is a flowchart of a common voltage control method of an embodiment of the present disclosure. As shown in FIG. 4, the common voltage control method includes step S41 of sensing an ambient temperature, and step S42 of adjusting the common voltage according to a temperature signal, so as to provide a corresponding common voltage to the common electrode according to the ambient temperature. The corresponding common voltage may enable the display panel to have the smallest flicker at the sensed ambient temperature.

In step S41, the ambient temperature may be sensed using the temperature sensing circuit 2 to generate a temperature signal, and the temperature signal may be transmitted to the voltage adjustment circuit 3. For example, the temperature sensor 201 can measure and obtain the ambient temperature of 40° C. when used, and transmit to the microcontroller 301 a digital signal or a voltage signal representing the ambient temperature of 40° C.

In step S42, the voltage adjustment circuit 3 may be used to provide the common electrode 5 with a common voltage according to the temperature signal. For example, referring to the curve of FIG. 3, the microcontroller 301 obtains, according to the stored curve, that the required input of the digital potentiometer 302 is 489, and the microcontroller 301 inputs 489 to the digital potentiometer 302. At this time, the digital potentiometer 302 performs a voltage division on the reference power source to obtain a desired common voltage.

The common voltage control method according to the embodiment of the present disclosure controls the common voltage according to the temperature signal and can prevent the occurrence of image sticking at different temperatures. Moreover, the stored ambient temperature—digital potentiometer input relationship curve can be used to easily achieve the adjustment of the common voltage.

Figure 5:
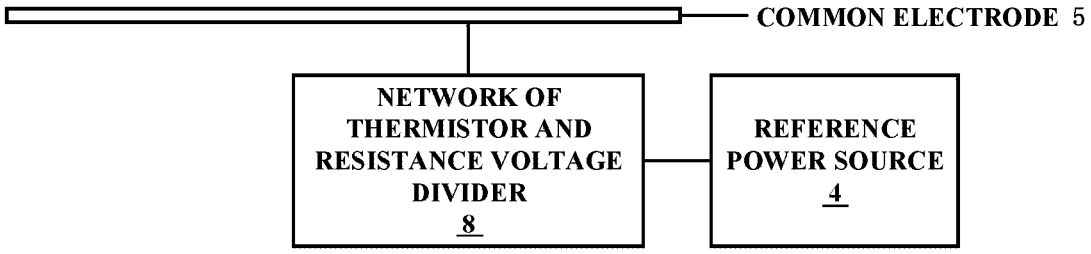
FIG. 5 is another schematic block diagram of the common voltage control circuit shown in FIG. 1.
Figure 6:
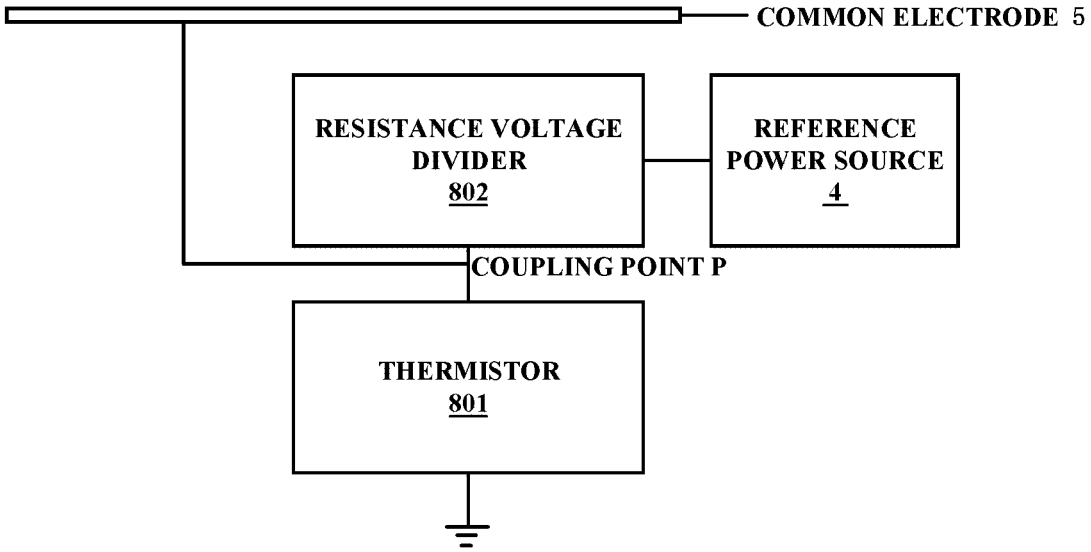
FIG. 6 is a schematic structural diagram of a network of a thermistor and a resistance voltage divider shown in FIG. 5.

FIG. 5 is another schematic block diagram of the common voltage control circuit shown in FIG. 1. FIG. 6 is a schematic structural diagram of the network of the thermistor and the resistance voltage divider shown in FIG. 5. As shown in FIG. 5 and FIG. 6, the temperature sensing circuit 2 and the voltage adjusting circuit 3 can be simply implemented using a network 8 of the thermistor and the resistance voltage divider. The network 8 of the thermistor and the resistance voltage divider may include a thermistor 801 and a resistance voltage divider 802. Specifically, the thermistor 801 may be connected in series with the resistance voltage divider 802, the resistance voltage divider 802 is further coupled to the reference power source 4, and the thermistor 801 is further grounded. The coupling point between the thermistor 801 and the resistance voltage divider 802 is further coupled to the common electrode 5. The resistance of the thermistor 801 varies as the ambient temperature varies. Here, a positive thermistor, of which the resistance increases as temperature increases, is selected. When the resistance of the thermistor 801 increases, the voltage drop across the thermistor 801 increases and the voltage at the coupling point P increases. As a result, the common voltage rises. When the resistance of the thermistor 801 drops, the voltage drop across the thermistor 801 drops and the voltage at the coupling point P drops. Therefore, the common voltage drops.

The circuits shown in FIG. 5 and FIG. 6 have few components and a simple structure. For example, the resistance voltage divider 802 can be directly implemented by a fixed resistor, which is especially suitable for small space applications and can achieve a substantially proportional relationship curve between ambient temperature and common voltage well. It should be understood that the circuit can also be easily modified to achieve a more complex curve. For example, the resistance voltage divider 802 can also be a digital potentiometer, and the resistance thereof can be adjusted by the microprocessor according to the ambient temperature, so as to achieve a more complex curve as shown in FIG. 3, as well as to achieve functions such as the limitation of the range of adjustment of the common voltage. In addition, the thermistor 801 may also be easily disconnected from the circuit or shorted to avoid the effect on the common voltage, when the ambient temperature is below normal temperature, for example, within a temperature range not required for the adjustment of the common voltage.

A third aspect of the present disclosure further provides a display panel, including the above-mentioned common voltage control circuit.

A fourth aspect of the present disclosure further provides a display device, including the above-mentioned display panel. The display device may be any product or component having a display function such as a mobile phone, a tablet computer, a television, a display, a notebook computer, a digital photo frame, a navigator, and the like.

According to the common voltage control circuit and method, the display panel and the display device according to the embodiments of the present disclosure, the common voltage can be changed to prevent the occurrence of image sticking at different temperatures.

It can be understood that the above-mentioned embodiments are merely exemplary embodiments used for illustrating the principle of the present disclosure, but the disclosure is not limited thereto. For those of ordinary skill in the art, various modifications and improvements may be made without departing from the spirit and essence of the present disclosure, and these variations and improvements are also considered as the protection scope of the present disclosure.

What is claimed is:

1. A control circuit for controlling a common voltage applied to a common electrode of a display panel, the control circuit comprising:

a temperature sensing circuit configured to sense an ambient temperature of the display panel; and a voltage adjusting circuit, coupled to the temperature sensing circuit and the common electrode, the voltage adjusting circuit configured to provide a corresponding common voltage to the common electrode based on a temperature signal from the temperature sensing circuit, wherein the corresponding common voltage causes the display panel to have a smallest flicker at the sensed ambient temperature;

wherein the temperature sensing circuit comprises a thermistor;

wherein the voltage adjusting circuit comprises a resistance voltage divider;

wherein the thermistor is directly coupled in series between the resistance voltage divider and a ground;

wherein the resistance voltage divider is further directly coupled to a reference power source;

wherein a coupling point, at which the resistance voltage divider and the thermistor are coupled in series, is directly coupled to the common electrode; and wherein the resistance voltage divider is a fixed resistor.

2. A control method for controlling the control circuit according to claim 1, so as to apply the common voltage to the common electrode of the display panel, the control method comprising:

sensing the ambient temperature; and providing the corresponding common voltage to the common electrode based on the ambient temperature.

3. The control method according to claim 2, wherein the corresponding common voltage causes the display panel to have the smallest flicker at the sensed ambient temperature.

4. The control method according to claim 3, wherein providing the corresponding common voltage to the common electrode based on the ambient temperature comprises:

determining a common voltage value corresponding to the ambient temperature, based on the ambient temperature and a pre-established correlation between the ambient temperature of the display panel and the common voltage for the smallest flicker; and providing the common electrode with the corresponding common voltage based on the corresponding common voltage value.

5. The control method according to claim 2, wherein the common voltage is set to increase as the ambient temperature increases within a specified range from a normal temperature to a high temperature.

6. The control method according to claim 5, wherein the specified range from the normal temperature to the high temperature is a range from greater than or equal to 25° C. to less than or equal to 50° C.

7. The control method according to claim 2, wherein an adjustment range of the common voltage is a range from greater than or equal to a first threshold to less than or equal to a second threshold.

8. The control method according to claim 7, wherein the first threshold is equal to the common voltage corresponding to the smallest flicker at the normal temperature subtracted by 1V, and wherein the second threshold is equal to a common voltage value corresponding to the smallest flicker at the normal temperature added with 1V.

9. The display panel comprising the control circuit according to claim 1.

10. A display device comprising the display panel according to claim 9.

* * * * *